US005428844A

United States Patent [19]

Dougherty

[11] Patent Number: 5,428,844

[45] Date of Patent: Jul. 4, 1995

[54] REMOVABLE, ADVERTISING, SWEAT-ABSORBING CUSHIONING BAND FOR HEADGEAR

[75] Inventor: Gary L. Dougherty, Whittier, Calif.

[73] Assignee: Lee's Sweat, Inc., Whittier, Calif.

[21] Appl. No.: 73,685

[22] Filed: Jun. 7, 1993

Related U.S. Application Data

[63] Continuation-in-part of Ser. No. 859,890, Mar. 30, 1992, abandoned.

[51] Int. Cl.[6] ..... A42B 1/24

[52] U.S. Cl. ..... 2/209.13; 2/181; 2/181.4; 2/195.1; 2/DIG. 11

[58] Field of Search ..... 2/170, 171, 171.4, 171.5, 2/171.7, 171.8, 181, 181.2, 181.4, 181.6, 183, 195.1, 195.2, 195.3, 195.4, 207, 209.13, 417, 418, 422, 909, 918, DIG. 11; 5/465, 645, 922; 206/5 R

[56] References Cited

U.S. PATENT DOCUMENTS

| | | | |
|---|---|---|---|
| 3,618,140 | 11/1971 | Goldfarb | 2/207 |
| 3,879,775 | 4/1975 | Iwata | 5/645 |
| 4,502,156 | 3/1985 | Wishman | 2/DIG. 11 |
| 5,058,211 | 10/1991 | Hanks | 2/DIG. 11 |
| 5,287,559 | 2/1994 | Christiansen et al. | 2/DIG. 11 |

FOREIGN PATENT DOCUMENTS

| | | | |
|---|---|---|---|
| 404796 | 10/1968 | Australia | 5/465 |

*Primary Examiner*—Clifford D. Crowder
*Assistant Examiner*—Diana L. Biefeld
*Attorney, Agent, or Firm*—Kathleen T. Petrich

[57] ABSTRACT

A cushioning, sweat-absorbing, advertising sweatband which is easily attached and removed from an existing hat or headgear that has an exposed headband. The band is a piece of material that has a foam cushion inserted inside the material and sewn in such a way as to form three distinct rectangles which are wrapped around each other and mate together through hook and loop fasteners over the exposed headband of a hat, such as an adjustable baseball cap.

6 Claims, 1 Drawing Sheet

FIG. 1
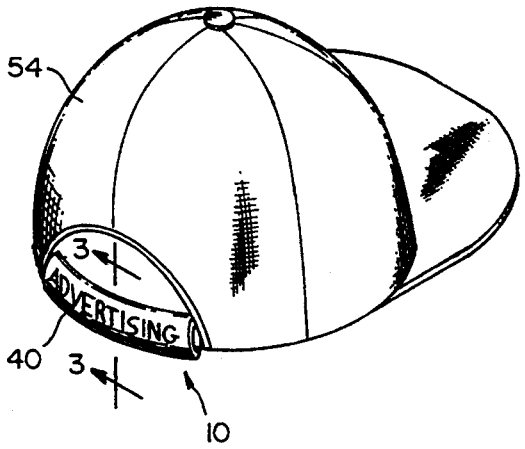
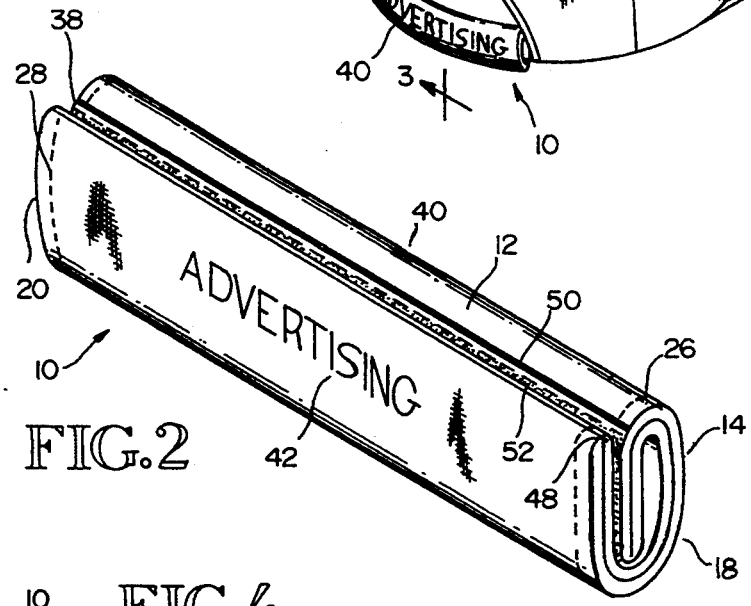
FIG. 2
FIG. 3
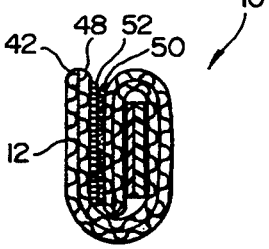
FIG. 4
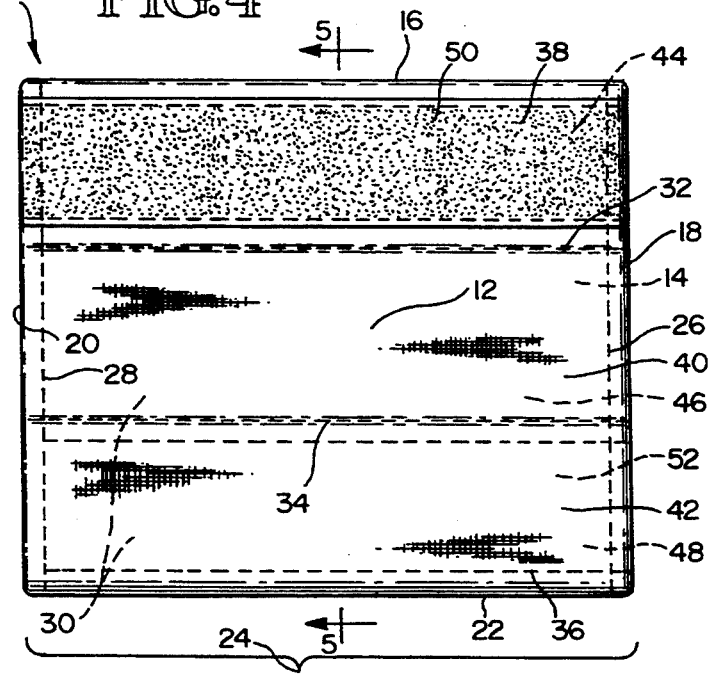
FIG. 5
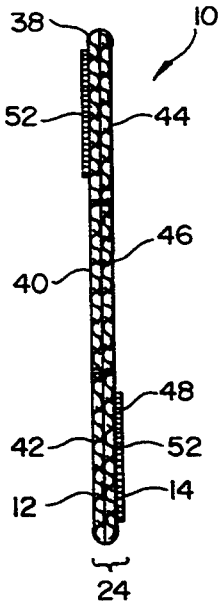

REMOVABLE, ADVERTISING, SWEAT-ABSORBING CUSHIONING BAND FOR HEADGEAR

This is a continuation-in-part of application Ser, No. 07/859,890 filed on Mar. 30, 1992 now abandoned.

TECHNICAL FIELD

This application relates to a cushioning band for headgear that is sweat-absorbing, removable and has ample space for advertising. The said band folds over on itself to fit over headgear with an adjustable headband.

BACKGROUND OF THE INVENTION

Headgear of all varieties has been in existence since the dawn of mankind. People wear hats for protection from the elements, for fashion, advertising, peer or group association and vanity. Adjustable baseball caps have provided all of the above-mentioned features; however, the caps do not provide comfort to the wearer, any means for absorbing sweat, nor extra advertising capability around the usually unattractive adjustable band. A sweat-absorbing, cushioning band would augment the needs of the adjustable headgear. In addition, the cushioning band should also be capable of promoting some form of advertising and be easily removable.

Several U.S. patents have addressed some, but not all, of these needs. Pizzacar U.S. Pat. No. 5,003,640 discloses an advertising cap that has an additional band that attaches to the exposed headband of the said cap and that such band can be used for advertising. However, Pizzacar does not disclose or suggest the band is there to provide comfort for the wearer or aids in sweat absorption.

Nunnery et al U.S. Pat. No. Re. 33,430 discloses a sweat-absorbing band, but does not teach or disclose a foam insert for cushioning nor an advertising means. Nunnery discloses the attachment of their claimed invention to the inside of an existing piece of headgear, primarily a safety hat.

Konucik U.S. Pat. No. 4,941,210 discloses a sweat-absorbing insert for headgear or other garments that can be quickly changed. Konucik does not disclose a means for advertising.

Other prior art suggests and discloses various sweatbands that provide sweat-absorption and/or cushioning for the wearer: Dootson, U.S. Pat. No. 3,578,736; Bloom, U.S. Pat. No. 4,406,021; and Sullivan, U.S. Pat. No. 4,856,116. None of these suggest a means for advertising.

Other prior art suggests and discloses a means for advertising that is associated with headgear, such as Doty, U.S. Pat. No. 4,993,080, and Rendina, U.S. Pat. No. 4,918,758; however, neither of these patents disclose a means for sweat-absorption or cushioning.

Harris U.S. Pat. No. 4,499,741 discloses an advertising terry cloth headband, but does not disclose any means for attaching this band to an existing hat or headgear.

DISCLOSURE OF THE INVENTION

This invention provides a method for providing a comfortable fabric band that wraps around an existing exposed headband of a hat or headgear that provides sweat-absorption, comfort through cushioning, a means for advertising, and is easily attachable to and removable from any existing hat or headgear with an exposed headband.

The fabric is made of sweat-absorbing material and contains a cushioning element, such as foam, that absorbs sweat and provides comfort at the same time. The foam is sewed inside an opening of the folded fabric as to form three rectangular panels on a side that fold over each other to expose at least one panel that is provided for advertising. This cushioning band attaches to itself over the exposed hat headband by mating one front rectangular panel with one back rectangular panel via VELCRO® or other attachment means. The fabric can be any color or any sweat-absorbing material. Likewise, the color of the thread for sewing the foam inside the fabric or for attaching the VELCRO® onto the fabric can be any color as well.

BRIEF DESCRIPTION OF THE DRAWINGS

FIG. 1 is a pictorial view of the cushioning, sweat-absorbing, advertising sweatband that is wrapped around the exposed headband of an adjustable baseball cap according to the preferred embodiment of the invention.

FIG. 2 is a pictorial view of the cushioning, sweat-absorbing, advertising sweatband by itself.

FIG. 3 is a sectional side view, taken substantially along lines 3—3 of FIG. 1, showing the cushioning, sweat-absorbing, advertising band wrapped up by itself.

FIG. 4 is a front view of the cushioning, sweat-absorbing, advertising band as it looks when it is laid out flat and unwrapped.

FIG. 5 is a sectional view, taken substantially along lines 5—5 of FIG. 4.

BEST MODE FOR CARRYING OUT THE INVENTION

Referring to the several figures of the drawing, and first to FIG. 4, therein shown at 10 is the inventive subject matter which is preferably fabricated from a single piece of fabric which has front side 12, a back side 14, and four edges: a folded edge 16, a right edge 18, a left edge 20 and a bottom edge 22, and an opening at the bottom edge 24 between the front side 12 and the back side 14. The fabric 10 can be made of any absorbent material and can be of any color.

The fabric 10 is sewed along the right edge 18 and connects the front side 12 and back side 14 together and creates the right seam 26. The fabric 10 is sewed along the left edge 20 and connects the front side 12 and the back side 14 and creates the left seam 28.

Cushioning material 30, such as foam in this invention's best mode, is inserted into the bottom opening 24 and positioned inside the opening 24 of the fabric 10 between the front side 12 and the back side 14. The cushioning material 30 is then sewn into the fabric 10 at two middle seams 32 and 34, thus securing the cushioning material 30 inside the fabric 10 between the front side 12 and back side 14. Middle seam 32 is sewn approximately one-third the length of the right edge 18 from the folded edge 16, and middle seam 34 is sewn approximately two-thirds the length of the right edge 18 from the folded edge 16, following the insertion of the cushioning material 30. The opening 24 at the bottom edge 22 is sewn together along the bottom edge 22 to form a bottom seam 36, thus securing the front side 12 and back side 14 together at the bottom edge 22.

The folded edge 16, the bottom seam 36, the two middle seams 32 and 34 define three approximately equal-sized rectangles, 38, 40, 42 on the front side 12, and rectangles 44, 46 48 on the back side 14. Rectangles 38 and 44 are defined by the folded edge 16, middle seam 32, right seam 26 and left seam 28, where rectangle 38 is that shown on the front side 12, and 44 is the rectangle on the back side 14. Rectangles 40 and 46 are defined by the middle seam 32, middle seam 34, right seam 26 and left seam 28 where rectangle 40 is that shown on the front side 12, and 46 is the rectangle on the back side 14. Rectangles 42 and 48 are defined by middle seam 34, bottom seam 36, right seam 26 and left seam 28, where rectangle 42 is shown on the front side 12, and rectangle 48 is the back side 14. Rectangle 38 has a strip of loop fasteners 50, VELCRO® brand hooks and loops fastener in its preferred embodiment, attached via top stitching. Rectangle 48 has a strip of hook fasteners 52 (VELCRO®) attached via top stitching. Rectangles 40 and 42 are designed for advertising and manufacturer trademark information.

FIG. 5 depicts the fabric 10 from the side. The hook and loop (VELCRO®) strips 50 and 52 are attached to the fabric 10 at rectangles 38 and 48, respectively.

FIG. 2 depicts how the fabric 10 is wrapped around itself. Rectangles 38/44 are folded over rectangles 40/46. Rectangles 42/48 are folded around rectangles 40/46 to mate with rectangles 38/44. The specific mating occurs between rectangles 38 and 48. FIG. 3 shows a side view of the band wrapped around itself.

To use the cushioning band, the fabric 10 is wrapped around an exposed headband of an adjustable cap 54, as depicted in FIG. 1, so that the wearer of the hat has cushion and sweat-absorbing material closest to his or her skin. Rectangle 40 with advertising space can be easily seen.

I claim:

1. A removable sweatband and headgear having an exposed headband combination, comprising:

a non-rigid panel that has a top edge, bottom edge, right edge, left edge, front side and back side and is sized such that when folded fits over the exposed headband;

said panel is divided into three subpanels along a first axis and a second axis between said left edge and said right edge defining a first subpanel adjacent to the top edge, a third subpanel adjacent to the bottom edge, and a second panel therebetween;

first fastening material secured to one side of the first subpanel; and second fastening material secured to an opposite side of the third subpanel, wherein the three subpanels are folded along the two axes to wrap around the exposed headband of the headgear by folding the first subpanel over the third subpanel and mating the first and second fastening materials.

2. A removable sweatband and headgear combination, according to claim 1, wherein the sweatband is made of absorbent material.

3. A removable sweatband and headgear combination, according to claim 2, wherein cushioning material is inserted in said panel, thereby providing comfort and sweat absorption to a wearer of the headgear.

4. A removable sweatband and headgear combination, according to claim 3, wherein some cushioning material is located in said second subpanel.

5. A removable sweatband and headgear combination, according to claim 1, wherein the first fastening material is comprised of either hooks or loops and the second fastening material is comprised of mating material either hooks or loops.

6. A removable sweatband and headgear combination, according to claim 1, wherein the sweatband includes indicia on said front side such that the indicia is viewable when placed on the headgear.

* * * * *

UNITED STATES PATENT AND TRADEMARK OFFICE

CERTIFICATE OF CORRECTION

PATENT NO. : 5,428,844
DATED : July 4, 1995
INVENTOR(S) : Gary L. Dougherty

It is certified that error appears in the above-indentified patent and that said Letters Patent is hereby corrected as shown below:

Column 1, line 6, "Ser. No." should read--Ser. No.--

Signed and Sealed this

Twenty-first Day of May, 1996

Bruce Lehman

*Attest:*

BRUCE LEHMAN

*Attesting Officer*

*Commissioner of Patents and Trademarks*